US006762787B2

(12) United States Patent
Beier

(10) Patent No.: US 6,762,787 B2
(45) Date of Patent: Jul. 13, 2004

(54) FORMING AN IMAGE ON A PRINTING PLATE USING ULTRASHORT LASER PULSES

(75) Inventor: Bernard Beier, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/901,525

(22) Filed: Jul. 9, 2001

(65) Prior Publication Data

US 2002/0003569 A1 Jan. 10, 2002

(30) Foreign Application Priority Data

Jul. 7, 2000 (DE) ..... 100 33 161

(51) Int. Cl.[7] ..... B41J 2/47
(52) U.S. Cl. ..... 347/251
(58) Field of Search ..... 347/251, 238, 347/239, 252, 255

(56) References Cited

U.S. PATENT DOCUMENTS 3,657,510 A * 4/1972 Rothrock ..... 219/121.11
4,253,724 A * 3/1981 Minoura et al. ..... 359/206
4,716,569 A * 12/1987 Bees ..... 372/38.04
5,208,819 A * 5/1993 Huber ..... 372/32
5,388,113 A * 2/1995 Oka ..... 372/21
5,874,981 A * 2/1999 Haas et al. ..... 347/187
5,940,115 A * 8/1999 Nakamura et al. ..... 347/251
6,043,453 A 3/2000 Arai ..... 219/121.68
6,366,308 B1 * 4/2002 Hawryluk et al. ..... 347/256
6,614,815 B1 * 9/2003 Kane et al. ..... 372/6

FOREIGN PATENT DOCUMENTS

| | | |
|---|---|---|
| DE | 38 06 785 A1 | 9/1988 |
| DE | 39 34 865 A1 | 4/1991 |
| DE | 195 44 502 C1 | 5/1997 |
| DE | 196 17 552 A1 | 11/1997 |
| DE | 198 41 040 A1 | 3/1999 |

* cited by examiner

*Primary Examiner*—Michael Nghiem
(74) *Attorney, Agent, or Firm*—Laurence A. Greenberg; Werner H. Stemer; Ralph E. Locher

(57) ABSTRACT

A device for forming an image on a printing plate includes at least one laser, and an optical system for forming an image of radiation from the laser on the printing plate, the laser radiation having ultrashort pulses with a duration of less than 1 ns; a printing unit having at least one of the imaging devices; and a printing machine with at least one of the printing units.

10 Claims, 2 Drawing Sheets

FORMING AN IMAGE ON A PRINTING PLATE USING ULTRASHORT LASER PULSES

BACKGROUND OF THE INVENTION

Field of the Invention

The invention relates to a device for forming an image on a printing plate having at least one laser and an optical system for forming an image of laser radiation on the printing plate.

It has been known for some time that it is possible to form an image on a printing plate, whether the latter has a planar or curved surface, by irradiating the surface thereof with intensive laser radiation. A physical or chemical change in the surface properties occurs as a result of the light/material interaction. In the case wherein the surface properties are changed by the thermal effect of the laser radiation, a specific threshold energy density is necessary for producing a dot. The density depends, amongst other things, on the material parameters of the printing plate and the time duration of the irradiation. If the energy density is lower than the threshold energy density, then no dot is produced even if exposure occurs over a very long period of time. Typically, the threshold energy density decreases with decreasing time duration of the irradiation by the laser.

For forming images on printing plates, radiation which is generated during continuous operation of the laser, so-called continuous-wave operation, is used in many realized applications. The time duration of the irradiation by the laser is typically determined by the laser oscillation being switched on and off or the beam being interrupted, with the result that exposures in a range of microseconds or greater typically occur. A shorter time duration of the exposure can MD be achieved by using lasers which emit pulses. Q-switched lasers in pulse operation are proposed for a series of applications. This generally involves gas laser or solid-state laser systems.

U.S. Pat. No. 5,874,981 discloses how, by modulation of the energy supply of the light source that is used, amplitude and time modulation of the laser radiation that is generated can be effected, with the result that an image is produced on a surface. In this regard, the laser is used for short periods of time in continuous-wave operation.

The published German Patent Document DE 195 44 502 C1 describes a laser engraving installation. A modulated laser beam is used to form a desired profile in a workpiece surface. In this regard, the fine structures of the profile are formed by the beam of a first laser, which is amplitude-modulated by an acousto-optical modulator with a relatively high modulation frequency in the MHz range, while the deep regions of the desired profile are formed by the beam of a second laser. The modulator and the second laser radiation source are driven by mutually related, but separate control signals. The lasers are used for short periods of time in continuous-wave operation.

U.S. Pat. No. 5,208,819 describes a laser system for recording data patterns on a surface. A light modulator is exposed by the pulsed laser radiation of an excimer laser, with the result that a pattern can be projected onto a surface. The light modulator includes an array of deformable mirrors which can thus be switched between an activated and a deactivated state. In U.S. Pat. No. 5,940,115, a laser system is used which emits pulses in the microseconds range. This typically involves a gas laser, in particular a $CO_2$ laser. The laser pulses are used to write dots on a photosensitive material. The imaging onto the surface is effected by a reducing optical arrangement so that only the light reflected from the activated mirrors falls onto the surface.

U.S. Pat. No. 3,657,510 presents a Q-switched laser for altering surfaces. What is involved, in this regard, is an optically pumped laser, preferably a solid-state laser. The laser pulses generated by the Q-switching serve for forming an image of a mask, which is situated within the laser resonator, onto a surface. The irradiation with laser light results in an alteration of the surface, for example, by evaporation, heating, chemical reaction or oxidation.

For forming an image on a printing plate, 0.5 J/cm$^2$ is typically necessary as threshold energy density in continuous-wave operation. If the dot size is about 10 micrometers, a threshold energy of 0.5 to 3 $\mu$J thus results. For image-forming using a diode laser, therefore, an output power of 100 to 500 mW is necessary per individual beam. The high optical power that is required necessitates a corresponding electrical power. It typically amounts to three watts per individual beam. As a consequence, corresponding cooling is necessary. Complicated air or water cooling makes it difficult to integrate the image-forming device in a compact form.

Gas laser or solid-state laser systems are less suitable for practical use in devices for forming an image on a printing plate, in particular in printing units or printing machines. Such systems require a complicated pump device for generating the laser oscillation, and typically have a large construction space mass and are expensive. Physical limits are imposed on the minimum pulse duration that can be achieved when generating pulses by Q-switched laser systems; minimum pulse durations are typically a few $10^{-8}$ seconds.

SUMMARY OF THE INVENTION

In view of the foregoing, it is an object of the invention, therefore, to provide an improved device for forming images on printing plates using radiation emitted by a laser, which may serve to achieve a lower threshold energy density.

With the foregoing and other objects in view, there is provided, in accordance with the invention, a device for forming an image on a printing plate, comprising at least one laser, and an optical system for forming an image of radiation from the laser on the printing plate, the laser radiation having ultrashort pulses with a duration of less than 1 ns.

In accordance with another feature of the invention, the laser radiation is generatable by a semiconductor laser.

In accordance with a further feature of the invention, the laser is installed for multimode operation and is mode-coupled.

In accordance with an added feature of the invention, the one laser has a supply current with ac and dc components.

In accordance with an additional feature of the invention, the one laser is an individual diode laser for generating the laser radiation.

In accordance with yet another feature of the invention, the at least one laser is a diode laser array for generating the laser radiation.

In accordance with yet a further feature of the invention, the diode laser array comprises individually drivable single-strip diode lasers.

In accordance with yet an added feature of the invention, the device for forming an image on a printing plate includes a control arrangement for temperature regulation of the laser.

In accordance with yet an additional feature of the invention, the optical system for forming an image of the radiation on the printing plate has reflective elements.

In accordance with still another feature of the invention, the optical system has micro-optical elements.

In accordance with still a further feature of the invention, the dc-component is able to be modulated.

In accordance with an added aspect of the invention, there is provided a printing unit having at least one device for forming an image on a printing plate, comprising at least one laser, and an optical system for forming an image of radiation from the laser on the printing plate, the laser radiation having ultrashort pulses with a duration of less than 1 ns.

In accordance with a concomitant aspect of the invention, there is provided a printing machine, comprising at least one printing unit having at least one device for forming an image on a printing plate, the device including at least one laser, and an optical system for forming an image of radiation from the laser on the printing plate, the laser radiation having ultrashort pulses with a duration of less than 1 ns.

The nonlinear dependence of the threshold energy density of thermal printing plates on the temporal pulse width of the laser radiation becomes clear for ultrashort pulses. At a pulse width of 10 ps, for example, a threshold energy density of 0.02 J/cm$^2$ results. This threshold energy density is a factor of 25 less than that in continuous-wave operation of the laser. In order to generate laser light pulses with a temporal width of a few nanoseconds to picoseconds, in particular, the method of mode coupling is known in the literature. See, for example, P. W. Milonni and J. H. Eberly, "Lasers", Wiley, New York, N.Y., 1988. Such a method can also be used in the case of diode lasers for generating short light pulses. Note, for example, P. Vasil'ev, "Ultrafast diode lasers", Artechhouse Inc., 1995.

Through the use of a laser which emits ultrashort pulses with a duration of less than 1 ns in the device, a lower average power is necessary, compared with continuous-wave operation, for the imaging per individual beam. In a preferred embodiment, a semiconductor laser is involved in this case. For pumping a pulsed laser, a lower electrical power is required during operation. Therefore, less cooling is required, with the result that the corresponding device can be configured more simply. Consequently, it is simpler to realize compact image-forming devices in integrated form. Furthermore, the lower thermal loading increases the service life of the lasers.

Other features which are considered as characteristic for the invention are set forth in the appended claims.

Although the invention is illustrated and described herein as embodied in as an imaging device for forming an image on a printing plate by using ultrashort laser pulses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
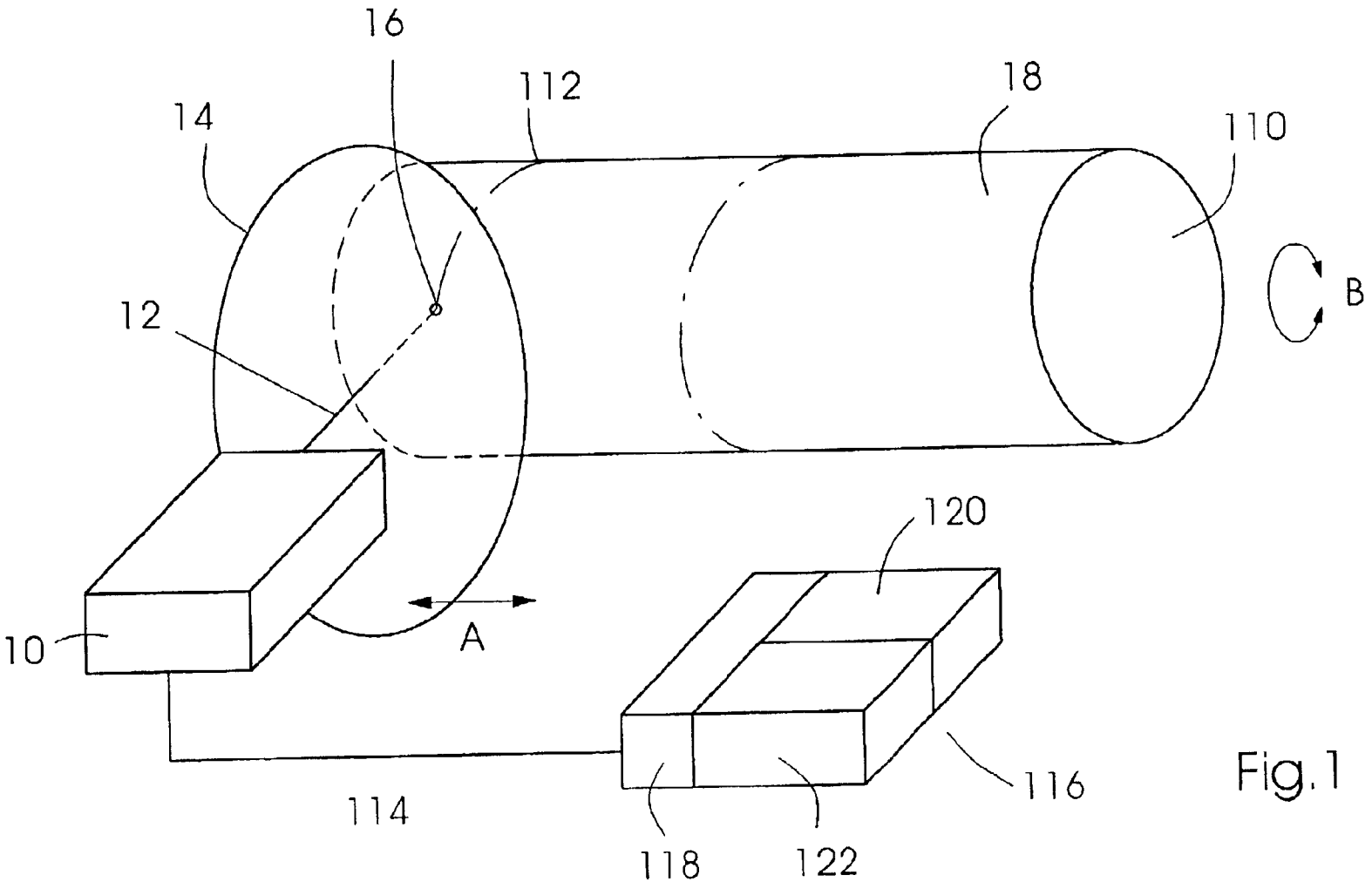
FIG. 1 is a schematic and diagrammatic side, top and front perspective view of an imaging device for forming an image on a printing plate by a pulsed laser which emits ultrashort pulses.

Referring now to the drawings and, first, particularly to FIG. 1, thereof, there is shown therein an imaging device for forming an image on a printing plate situated on a rotatable cylinder. A light source 10 generates a pulsed laser beam 12 which, through the intermediary of an imaging optical arrangement 14, forms an image of a dot 16 on the printing plate 18, which is situated on a cylinder 110. The cylinder 110 is rotatable about an axis of symmetry thereof. This rotation is represented by the double-headed arrow B. The light source 20 can be moved parallel to the axis of symmetry of the cylinder 110 on a linear path represented by the double-headed arrow A. For continuous image-forming, the cylinder 110 with the printing plate 18 rotates in accordance with the rotational movement B, and the light source 10 moves along the cylinder in accordance with the translatory movement A. The result is image-forming which revolves around the axis of symmetry of the cylinder 110 on a helical path. The path of the dots 16 is represented by the line 112. By a line 114 for power supply and control, the light source 10 which emits pulsed laser beams 12 is connected to the control unit 116. This control unit has a dc-source 120 and an ac-source 122 and also an electrical coupler 118, wherein the dc and ac components of the supply voltage of the light source 10 are combined. In an alternative exemplary embodiment, the dot 16 can also be moved in a meandering form over the printing plate 18 as follows: first, a complete image-forming process is performed along a line parallel to the axis of symmetry 110 of the cylinder 18 and then a stepwise rotation about the axis of symmetry of 110 of the cylinder 18 is performed.

It is believed to be clear that all that matters is a relative movement between the dot 16 and the printing plate 18. This relative movement can also be achieved by a movement of the printing cylinder 110. For both directions of movement of translation A and rotation B, the movement can be effected either continuously or stepwise.

Furthermore, in an alternative exemplary embodiment, the device for forming images on printing plates, having the light source 10, the imaging optical arrangement 14 and the like, can also be embodied within the printing cylinder 110, thereby providing a space-saving arrangement.

The rate of repetition of the light pulses 12 is at least just as great as the clock frequency for activating the individual printing dots, so that at least one laser pulse is available for a printing dot. The imaging optical arrangement 14 can have either reflective, transmissive, refractive or similar optical components. Micro-optical components are preferably involved in this case. The imaging optical arrangement 14 can have either a magnifying imaging scale or a reducing imaging scale or else imaging scales that are different in the two directions parallel and perpendicular to the active zone of the light source 10. The laser radiation alters the physical or chemical properties of the surface of the printing plate 18. Even further processing steps may be necessary until the surface can be used for the ultimate requirement thereof. However, the printing plate 18 may also be rewritable or erasable.

In a preferred embodiment, the control unit 116 can modulate the dc-current, with the result that the light intensity which is generated can be changed.

Figure 2:
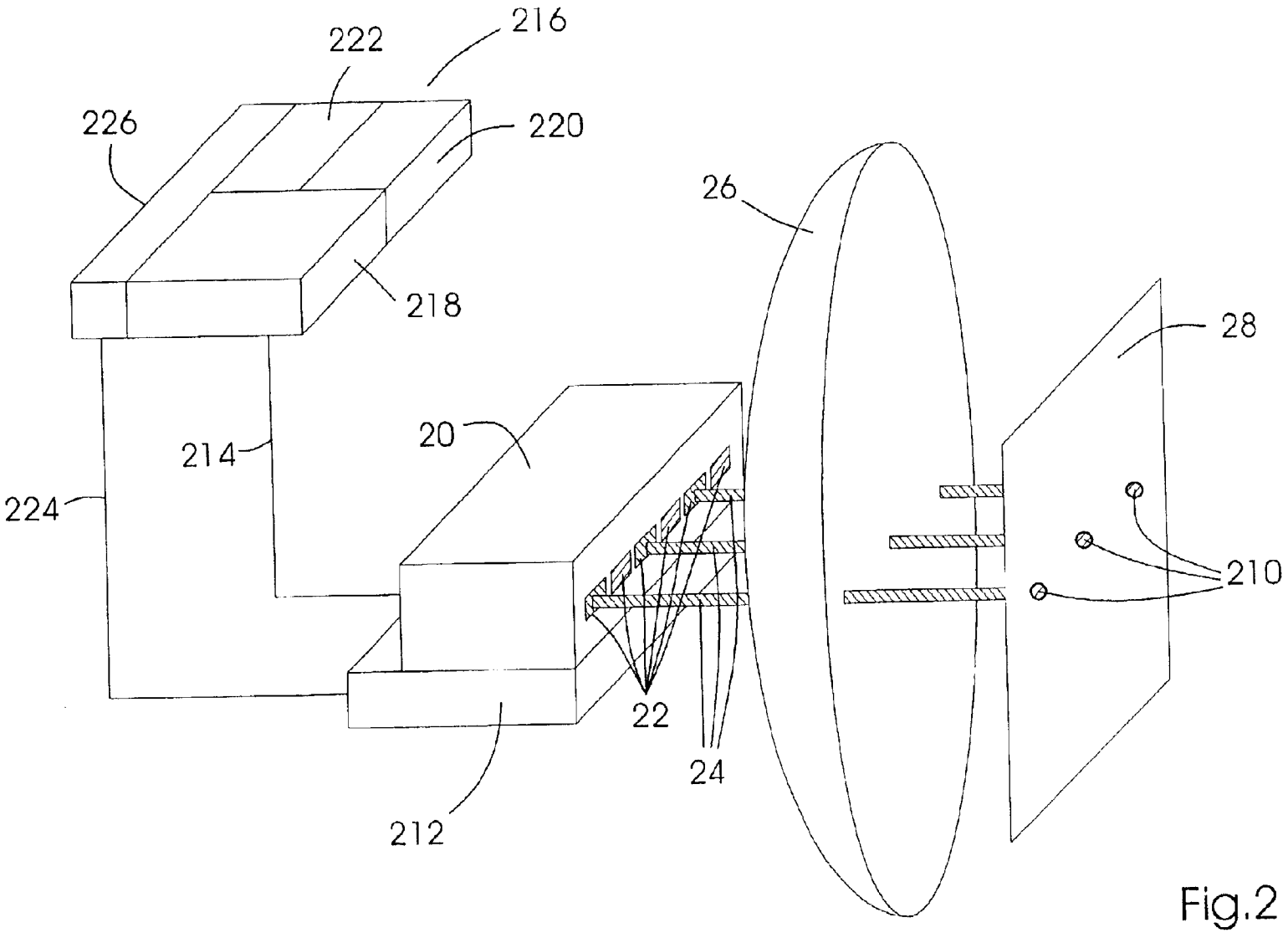
FIG. 2 is a schematic and diagrammatic side, top and front view of an imaging device for forming an image on a printing plate by an array of diode lasers which are operated in a pulsed manner.

FIG. 2 shows a device for forming an image on a printing plate, which has n laser light beams 24 generated by a diode laser array. The light source 20 includes an individually drivable array of n diode lasers which emit n light beams 24 having an ultrashort pulse length with a duration of less than 1 ns. Typically, a light source of this type has up to 100 single-strip diode lasers and, advantageously, between 10 and 60 thereof. The single-strip diode lasers have emitter areas 22, which typically have a size of $1\times5\ \mu m^2$, and emit laser radiation with an advantageous beam quality. Through the intermediary of an imaging optical arrangement 26, the n light beams 24 having an ultrashort pulse length with a duration of less than 1 ns form an image on the n dots 210 on the printing plate 28. The printing plate 28 is advantageously situated at the foci of the imaging optical arrangement 26. It is particularly advantageous that the imaging optical arrangement 26 both alters the laser beams in terms of the diameter ratio (perpendicular and parallel to the active zone 22), and corrects the distance between the laser beams 24. Generally, the distance between the individual emitters is constant but, for advantageous image-forming, it is only necessary for the distance between the n dots 210 to be constant, because this distance is determined by the imaging optical arrangement 26.

In a preferred embodiment, the light source 20 is situated on a cooling element 212. The light source 20 is connected to the control unit 216 by a line 214 for supplying and controlling power. The control unit 216 preferably has a dc-source 220, an ac-source 222 and an electrical coupler 218, wherein the dc, and ac components of the supply current are combined. Via a line for controlling the cooling element 224, the light source 20 is advantageously connected to a temperature regulating arrangement 226. The dc-component can be modulated in order to achieve a modulation of the radiation intensity.

Such a device according to the invention can be realized inside or outside a printing unit or a printing machine.

I claim:

1. A device for forming an image on a printing plate, comprising:

at least one semiconductor laser being supplied with a current using DC and AC components, being operated in multimode, being mode coupled and emitting laser radiation having ultra-short pulses with a duration of less than 1 ns; and an optical system for forming an image of the radiation from the laser on the printing plate.

2. The device for forming an image on a printing plate according to claim 1, wherein said one laser is an individual diode laser for generating the laser radiation.

3. The device for forming an image on a printing plate according to claim 1, wherein said at least one laser is a diode laser array for generating the laser radiation.

4. The device for forming an image on a printing plate according to claim 3, wherein said diode laser array comprises individually drivable single-strip diode lasers.

5. The device for forming an image on a printing plate according to claim 1, further including a control arrangement for temperature regulation of the laser.

6. The device for forming an image on a printing plate according to claim 1, wherein said optical system for forming an image of the radiation on the printing plate has reflective elements.

7. The device for forming an image on a printing plate according to claim 1, wherein said optical system has micro-optical elements.

8. The device for forming an image on a printing plate according to claim 1, wherein said dc-component is able to be modulated.

9. A printing unit, having at least one device for forming an image on a printing plate, comprising:

at least one semiconductor laser being supplied with a current using DC and AC components, being operated in multimode, being mode coupled and emitting laser radiation having ultra-short pulses with a duration of less than 1 ns; and an optical system for forming an image of the radiation from the laser on the printing plate.

10. A printing machine having at least one printing unit, comprising:

at least one semiconductor laser being supplied with a current using DC and AC components, being operated in multimode, being mode coupled and emitting laser radiation having ultra-short pulses with a duration of less than 1 ns; and an optical system for forming an image of the radiation from the laser on the printing plate.

* * * * *